US006702122B2

(12) United States Patent
Hopkins et al.

(10) Patent No.: US 6,702,122 B2
(45) Date of Patent: Mar. 9, 2004

(54) RACK FOR FORK LIFT EXTENSIONS

(75) Inventors: Frank G. Hopkins, 1420 Camp Rd., Buchanan, MI (US) 49107; Larry Thornton, Plymouth, IN (US)

(73) Assignee: Frank G. Hopkins, Buchanan, MI (US)

( * ) Notice: Subject to any disclaimer, the term of this patent is extended or adjusted under 35 U.S.C. 154(b) by 0 days.

(21) Appl. No.: 10/192,612

(22) Filed: Jul. 11, 2002

(65) Prior Publication Data

US 2004/0007542 A1 Jan. 15, 2004

(51) Int. Cl.[7] ..... A47F 7/00
(52) U.S. Cl. ..... 211/13.1; 211/60.1; 414/607
(58) Field of Search ..... 414/607; 211/13.1, 211/60.1, 204, 70.5

(56) References Cited

U.S. PATENT DOCUMENTS

RE22,895 E * 7/1947 Clapp
2,760,647 A * 8/1956 Saul
3,164,256 A * 1/1965 Bennett ..... 211/70.5
3,176,866 A * 4/1965 Meister
3,207,085 A * 9/1965 Bun
3,353,697 A * 11/1967 Martin et al.
3,583,061 A * 6/1971 Adams
3,685,667 A * 8/1972 Bell ..... 211/70.5
3,805,966 A * 4/1974 Wakeman et al.
4,239,122 A 12/1980 Klein
4,669,949 A * 6/1987 Sutton ..... 414/607 X
4,824,317 A * 4/1989 Schroder ..... 414/607
5,011,363 A 4/1991 Conley, III et al.
5,526,945 A 6/1996 Clark et al.
6,073,786 A 6/2000 McCorkle, Jr.

OTHER PUBLICATIONS

Web pages (1–3) of Vestil Manufacturing, copyright 2000.*
BFS, Vetter—Quality Forks, site maintained by (Phantom Mr NET)—no date.

* cited by examiner

*Primary Examiner*—Robert W. Gibson, Jr.
(74) *Attorney, Agent, or Firm*—Richard C. Litman

(57) ABSTRACT

A rack for storing unique fork lift extension members. The rack and extension members are designed and arranged in a manner to permit the extension members to be easily positioned on and removed from the tines of a fork lift without manual involvement. The storage rack is constructed of rugged metal to withstand the rigors of the warehouse or loading dock environment. The extension members are also constructed of metal and are fashioned with a unique U-shaped end or heel.

11 Claims, 7 Drawing Sheets

RACK FOR FORK LIFT EXTENSIONS

BACKGROUND OF THE INVENTION

1. FIELD OF THE INVENTION

The present invention generally relates to storage racks. More specifically, the present invention is drawn to a storage rack for fork lift extensions.

2. DESCRIPTION OF THE RELATED ART

The use of fork lifts for loading, unloading and moving crates and the like is a common occurrence in the freight industry. There are many instances when the size of the crate is such that standard-sized (length) fork lifts are not sufficient to carry the oversized crate without causing damage thereto. In such instances fork lift extensions are required.

As currently practiced, extensions must be manually positioned on the forks. An example of this is disclosed in the BFS, VETTER reference. To install an extension, the driver must get off the fork lift, select an extension and manually lift and position the extension on the fork tine. Besides contributing to a loss of time, the above procedure also risks injury (back strain, pinched fingers, etc.).

U.S. Pat. No. 5,011,363 (Conley, III et al.) discloses a fork extension system which utilizes a hydraulic system to automatically extend and retract the forks of a stockpicker. This system is complicated and initially costly. The system also requires expensive maintenance procedures.

U.S. Pat. Nos. 4,239,122 (Klein), 5,526,945 (Clark et al.) and 6,073,786 (McCorkle, Jr.) are drawn to storage rack structure which is not particularly adaptable to support fork extensions.

None of the above inventions and patents, taken either singularly or in combination, is seen to disclose fork lift, extensions and a storage rack therefor as will be subsequently described and claimed in the instant invention.

SUMMARY OF THE INVENTION

The instant invention is drawn to a rack for storing unique fork lift extension members. The rack and extension members are designed and arranged in a manner which permits the extension members to be easily positioned on and removed from the tines of the fork lift without manual involvement.

The storage rack is preferably constructed of rugged metal to withstand the rigors of the warehouse or loading dock environment. The rack may be built to meet the user's needs and may be designed to hold one set or any number of extension members. The rack may be disassembled and/or folded for shipment.

The extension members are also preferably constructed of metal and are fashioned with a unique U-shaped end or heel whose function will be explained below.

Accordingly, it is a principal object of the invention to provide a storage rack for fork lift extension members.

It is another object of the invention to provide a fork lift extension member, which member may be easily removed from a storage rack and positioned on a fork lift tine.

It is a further object of the invention to provide a fork lift extension member, which member may be easily removed from a fork lift tine and positioned on a storage rack.

Still another object of the invention is to provide a storage rack for fork lift extension members wherein positioning and removal of the extension members on and from fork lift tines requires no direct manual involvement.

It is an object of the invention to provide improved elements and arrangements thereof for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
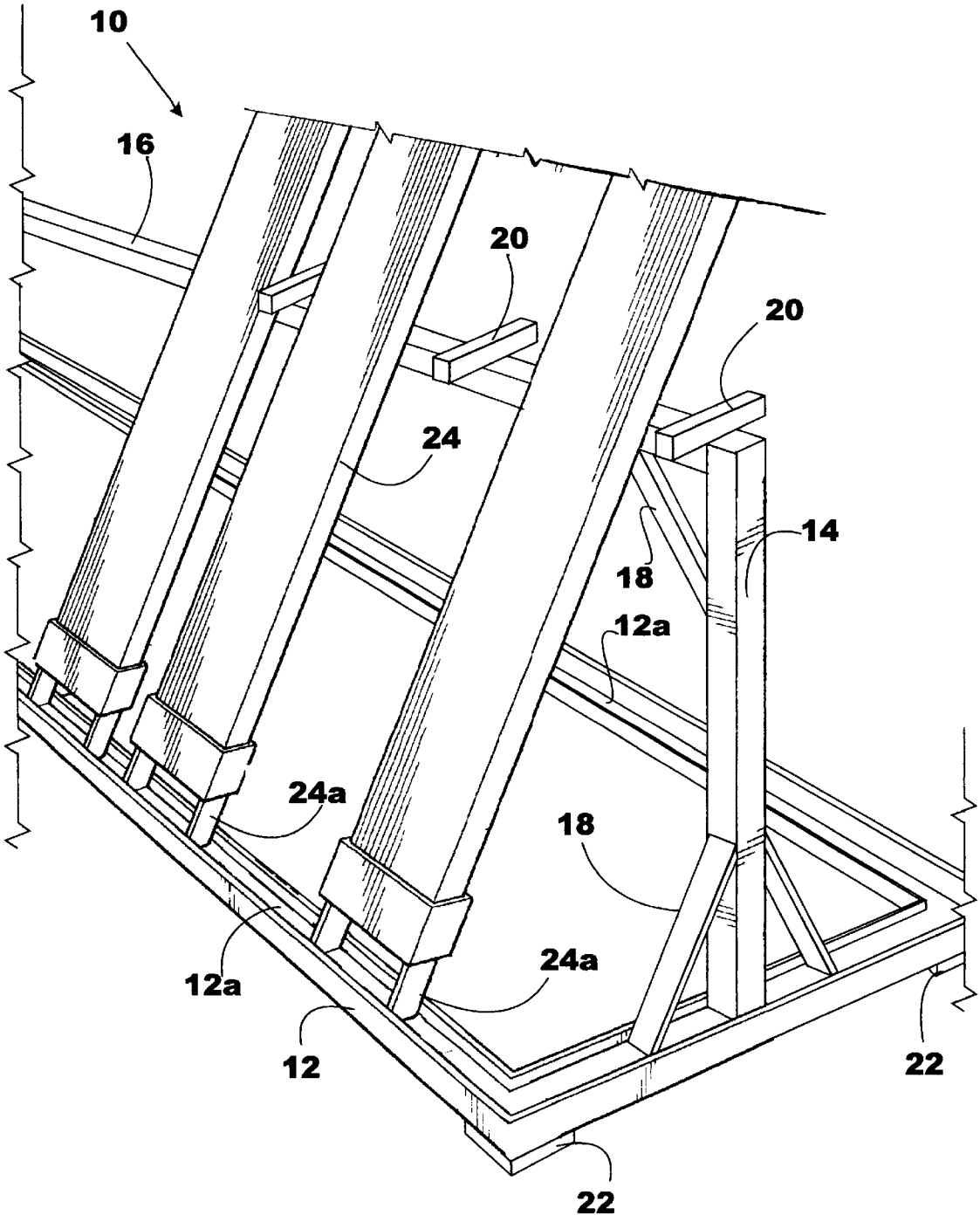
FIG. 1 is a partial, perspective view of a rack and fork lift extension members according to the present invention.
Figure 2:
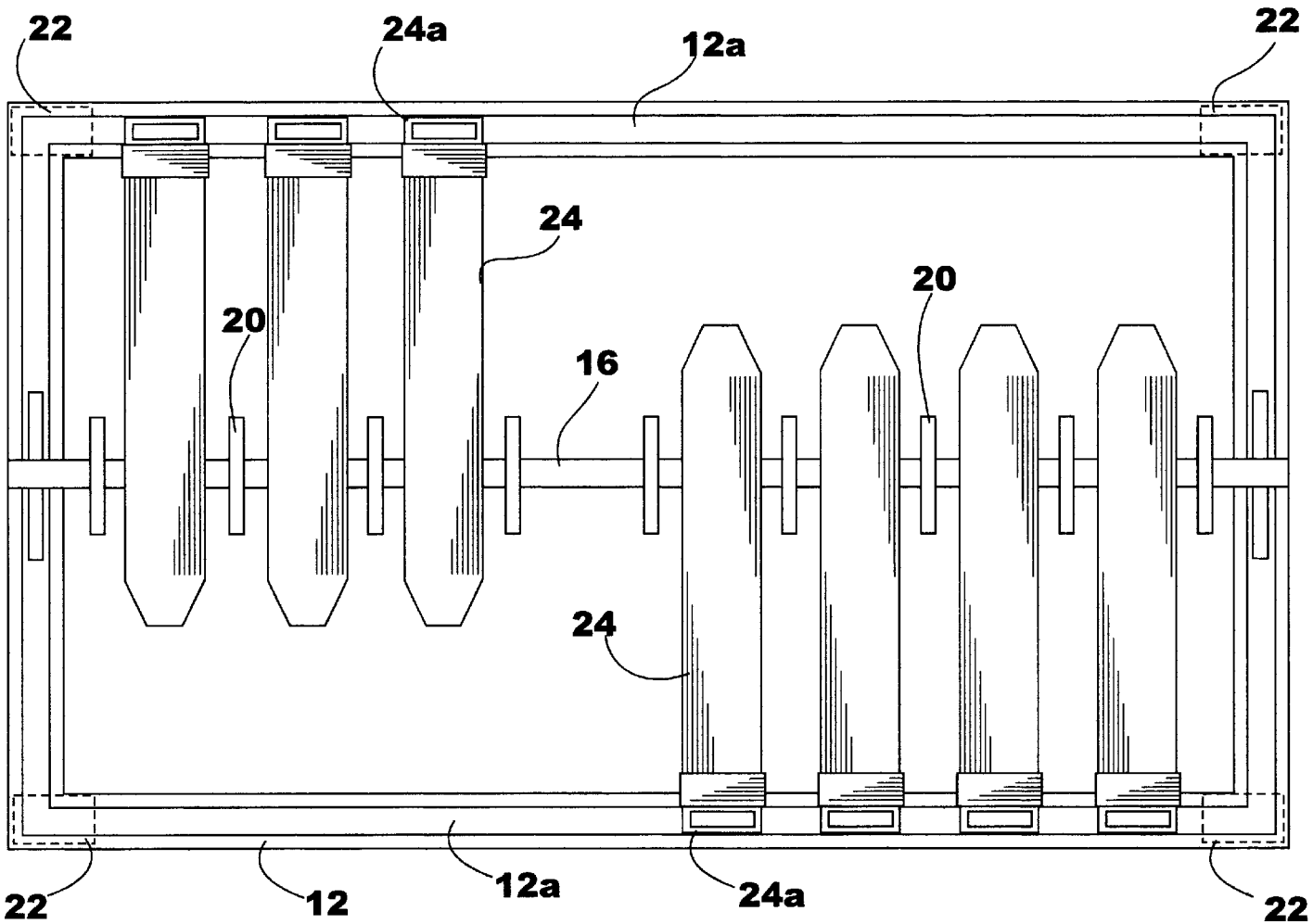
FIG. 2 is a top view of a rack and fork lift extension members according to the present invention.
Figure 3:
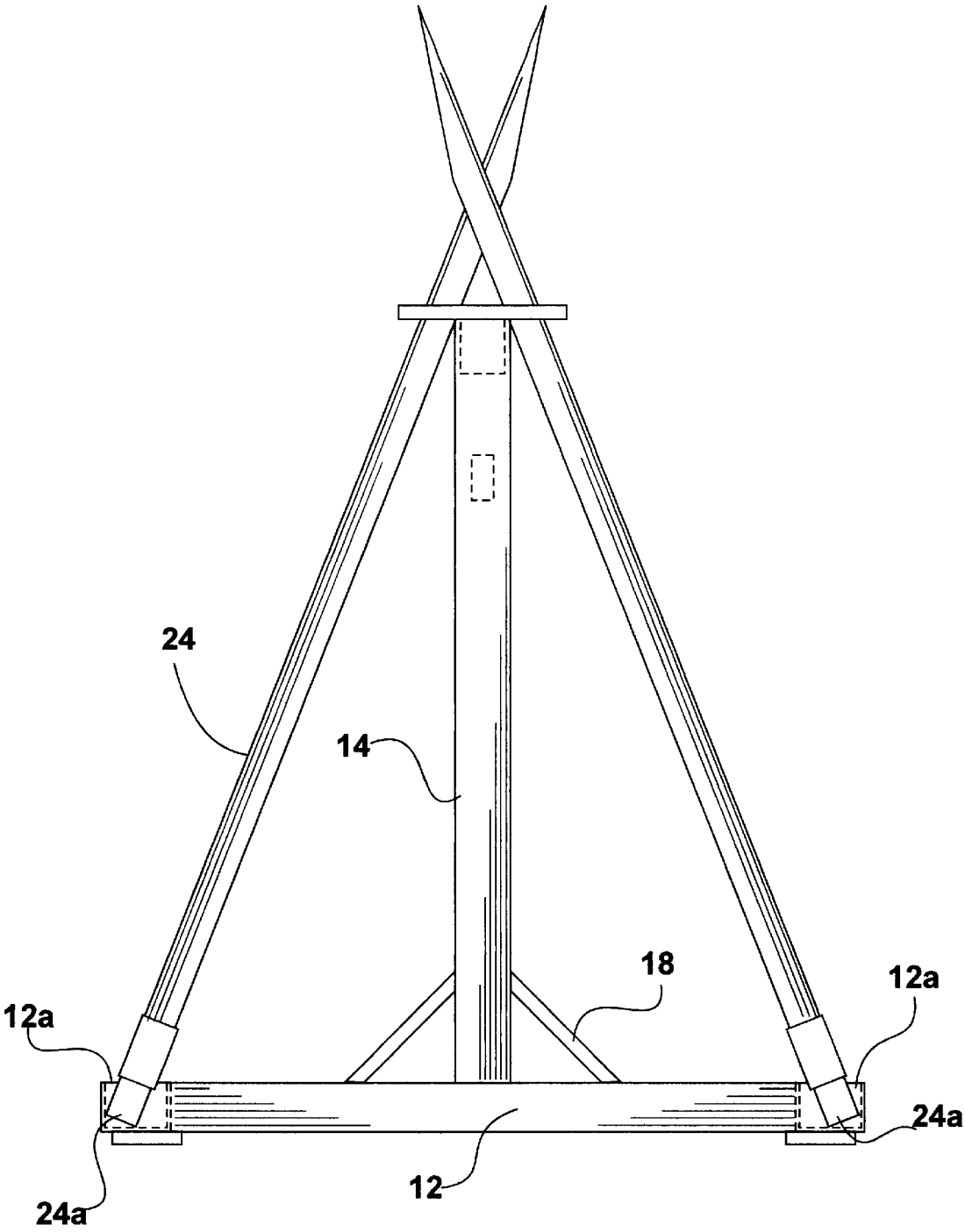
FIG. 3 is a side view of a rack and fork lift extension members according to the present invention.

Attention is first directed to FIGS. 1–3 wherein the storage rack and extension members which comprise the present invention are generally indicated at 10. The storage rack includes a rectangular member 12 which defines the base of the storage rack. At least the long sides of base 12 are constructed from members having a coextensive channel 12*a* therein. I-beams 14 are vertically disposed at each end of base 12 and are attached at their lower ends to base 12. A beam 16 spans the distance between and is attached to the top end of each member 14. Braces 18 provide structural support for the beams 14 and 16. Cross members 20 are evenly spaced along beam 16 and are attached thereto. Any of the conventional, well known construction techniques (welds, bolts, etc.) may be employed to attach the beams, base, braces and cross members. No-skid pads 22 are disposed at each corner of base 12. The dimensions of the storage rack are preferably forty-seven inches wide, sixty inches high and seventy-two inches long. The length may be varied to hold more or fewer extension members 20. The rack is constructed from standard channel iron stock or the like.

Figure 4:
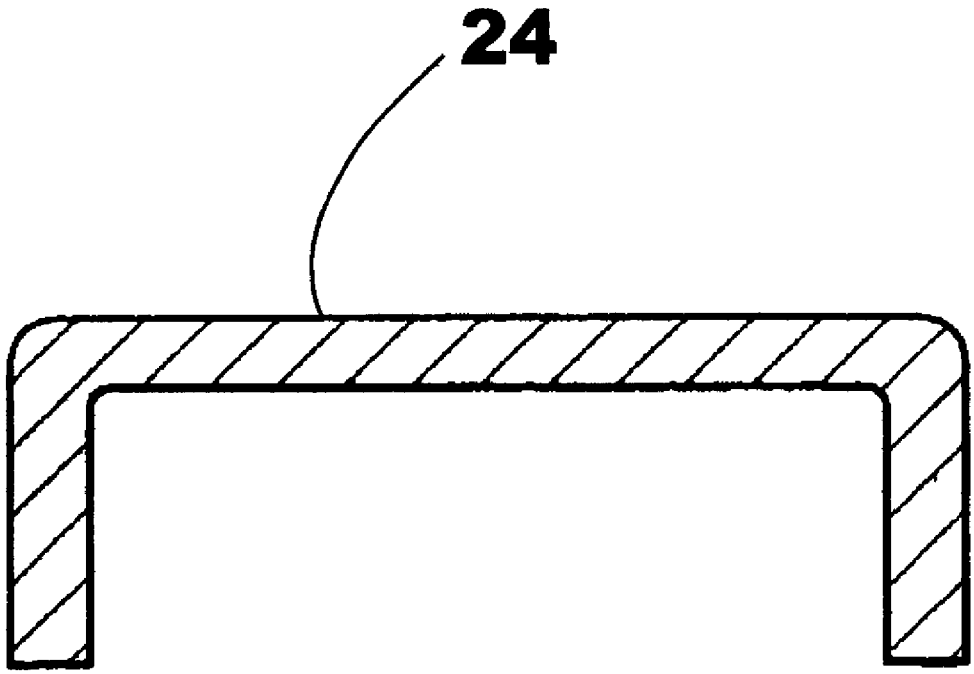
FIG. 4 is a cross-sectional view of a fork lift extension member according to the present invention.

Extension members 24 are elongate members having a U-shaped cross-section (FIG. 4). An open heel 24*a* defines the proximate end of each extension member. The heel 24*a* is adapted to be positioned in channel 12*a* for reasons that will be explained below. Each extension members 24 is preferably six inches wide and seventy-two inches long. The open heel 24*a* will add another three inches to the length of the extension member making a total length of seventy-five and one-half inches. Extension members 24 are positioned on either side of the storage rack. Cross members 20 function to keep the extension members in place on the rack.

Figure 5:
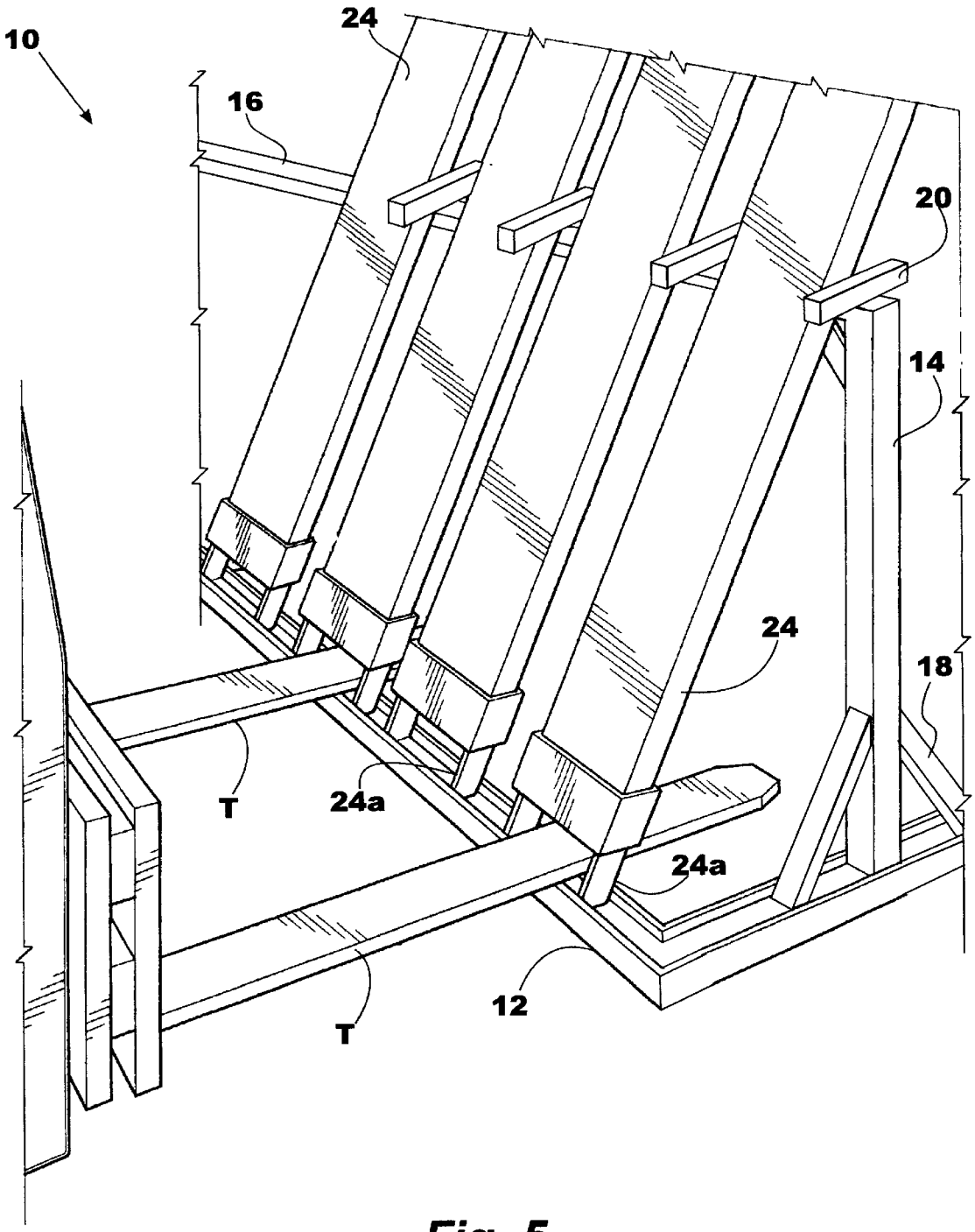
FIG. 5 is a partial, environmental, perspective view of a fork lift vehicle in the initial phase of adding extension members according to the present invention.
Figure 6:
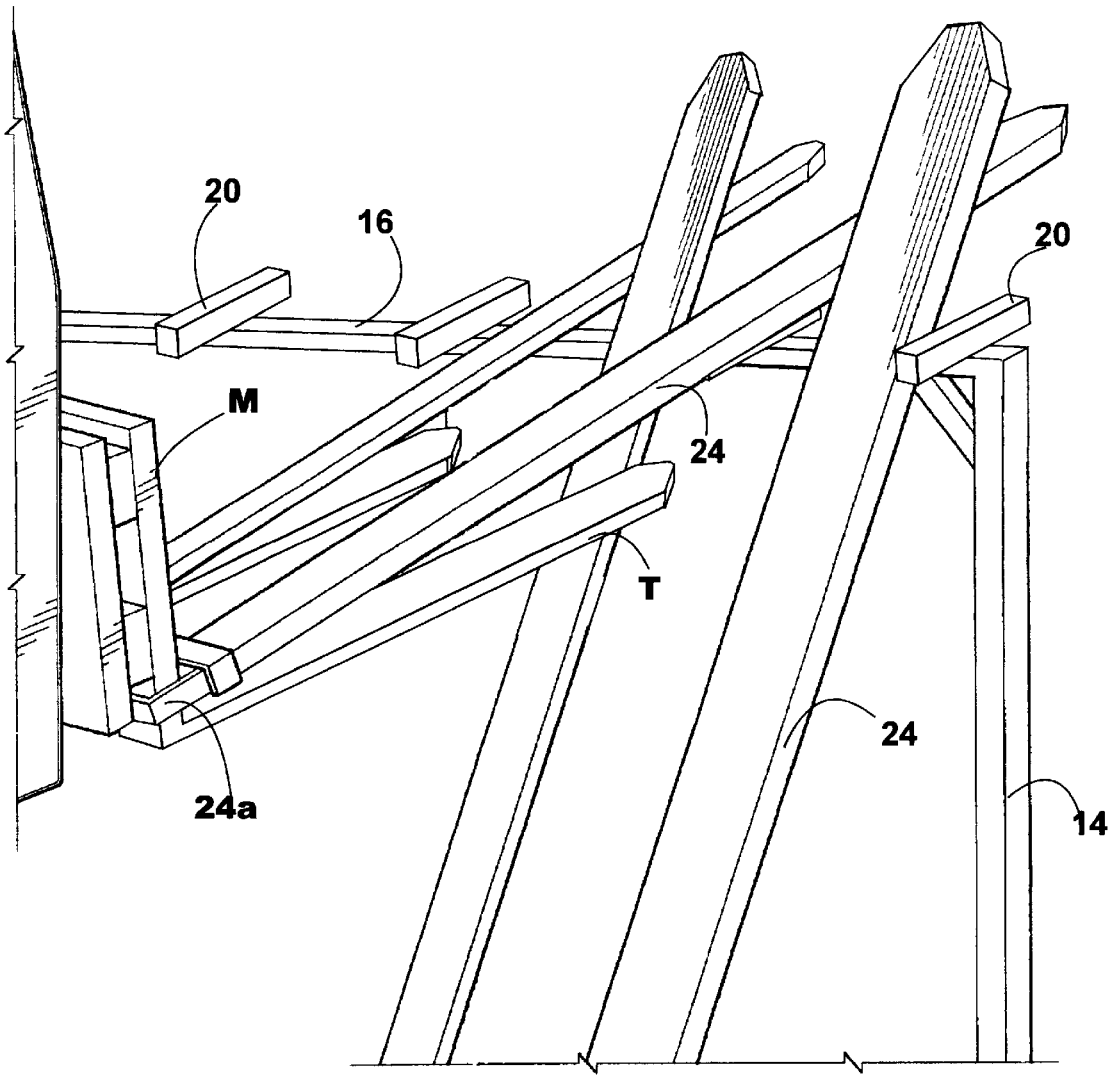
FIG. 6 is a partial, environmental, perspective view of a fork lift vehicle in the intermediate phase of adding extension members according to the present invention.
Figure 7:
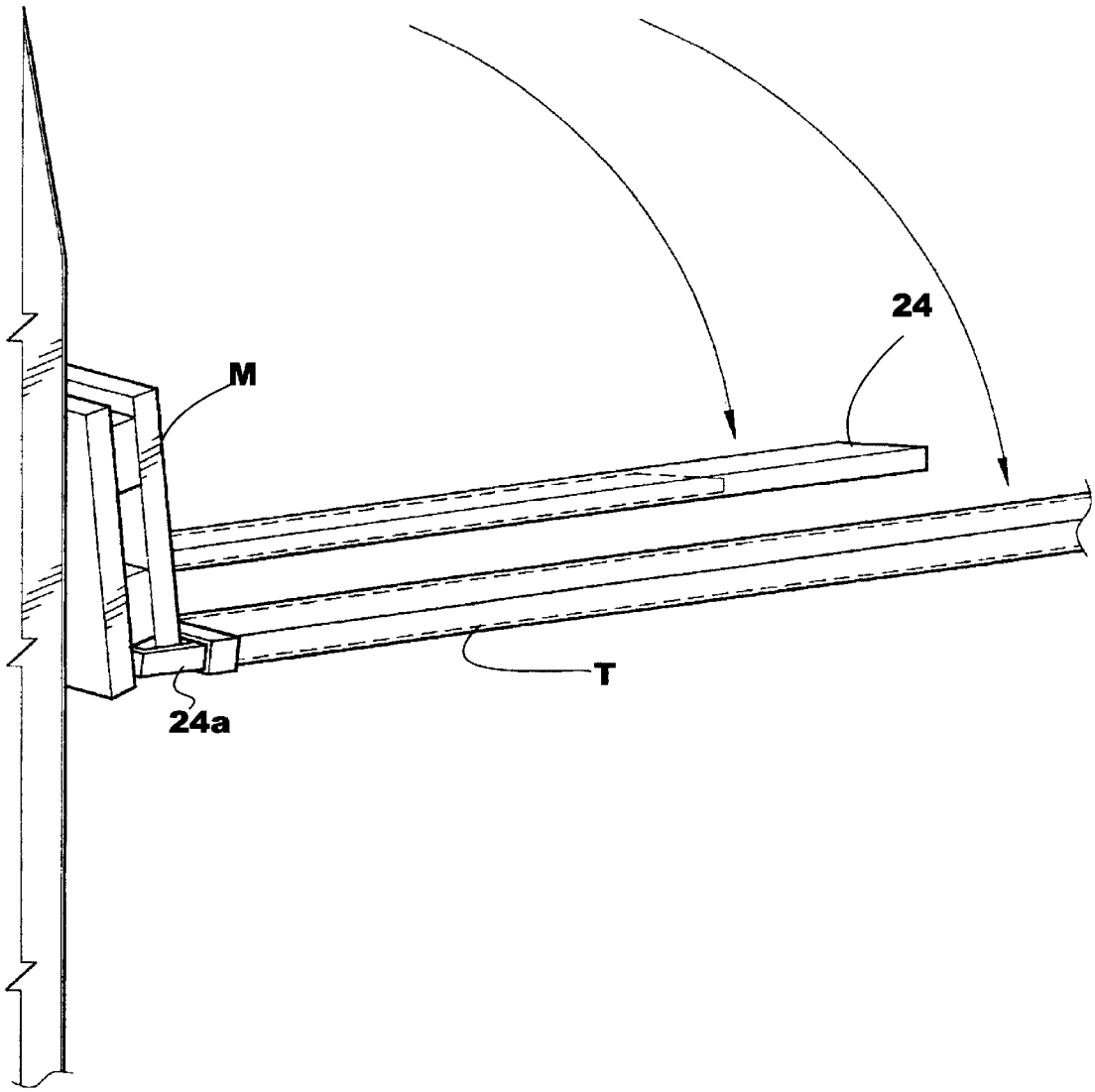
FIG. 7 is a partial, environmental, perspective view of a fork lift vehicle in the final phase of adding extension members according to the present invention.

FIGS. 5–7 are illustrative of the technique employed to position the extension members on the tines of a fork lift without the need for manual intervention. FIG. 5 shows the initial phase wherein the fork lift is driven to position the fork lift tines T through the openings in heel 24*a*. The intermediate phase (FIG. 6) requires the driver to raise the mast M of the fork lift to allow the extensions to slide onto the tines while still resting on beam 16. When the driver backs away from the rack, the extensions will fall into position on the tines (FIG. 7). To replace the extensions on the rack, the driver simply adjusts the mast to position the distal ends of the extensions on the beam 16. The driver then lowers the mast to drop the heels in the channel 12*a* as the fork lift is slowly backed away. The driver does not have to leave the fork lift for any manual intervention either in positioning the extensions on the tines or in putting the extensions back on the storage rack. The extension members may be accessed from either side of the rack.

It is to be understood that the present invention is not limited to the embodiment described above, but encompasses any and all embodiments within the scope of the following claims.

We claim:

1. The combination of a storage rack and fork lift extension member including:

a base member having an elongate first side and an elongate second side, said second side spaced a distance from and parallel to said first side;

a first member spanning the distance between and attached to said first side and said second side thereby defining a first end of said base member;

a second member spanning the distance between and attached to said first side and said second side thereby defining a second end of said base member;

a first beam, said first beam having a lower end attached to said first member and an upper end terminating vertically above said first member;

a second beam, said second beam having a lower end attached to said second member and an upper end terminating vertically above said second member;

a third beam, said third beam attached to said upper end of said first beam and said upper end of said second beam;

at least one elongate fork extension member, said fork extension member supported on said third beam member and one of said elongate first side and said elongate second side.

2. The combination of a storage rack and fork lift extension member as recited in claim 1, a respective channel formed in said elongate first side and said elongate second side.

3. The combination of a storage rack and fork lift extension member as recited in claim 2, wherein said extension member has a distal end and wherein said distal end is supported on said third beam.

4. The combination of a storage rack and fork lift extension member as recited in claim 3, wherein said extension member has a proximate end and wherein said proximate end is supported in one of said respective channels.

5. The combination of a storage rack and fork lift extension member as recited in claim 4, wherein said proximate end of said extension member terminates in an open heel portion.

6. The combination of a storage rack and fork lift extension member as recited in claim 5, wherein said extension member has a U-shaped cross-sectional configuration.

7. The combination of a storage rack and fork lift extension member as recited in claim 6, wherein said storage rack and said extension member are fabricated from metal.

8. The combination of a storage rack and fork lift extension member as recited in claim 7, including a plurality of cross members evenly spaced on said third beam.

9. The combination of a storage rack and fork lift extension member including:

a rectangularly-shaped base member having an under surface, an elongate first side and an elongate second side, said second side spaced a distance from and parallel to said first side;

a first member spanning the distance between and attached to said first side and said second side thereby defining a first end of said base member;

a second member spanning the distance between and attached to said first side and said second side thereby defining a second end of said base member;

a first beam, said first beam having a lower end attached to said first member and an upper end terminating vertically above said first member;

a second beam, said second beam having a lower end attached to said second member and an upper end terminating vertically above said second member;

a third beam, said third beam attached to said upper end of said first beam and said upper end of said second beam;

at least one elongate fork extension member, said fork extension member supported on said third beam member and one of said elongate first side and said elongate second side.

10. A storage rack for fork lift extension members as recited in claim 9, including plural skid pads attached to said under surface of said base.

11. A storage rack for fork lift extension members as recited in claim 10, wherein said rack has a height of approximately sixty inches, a width of approximately forty-seven inches and a length of approximately seventy-two inches.

* * * * *